United States Patent [19]

Lonati

[11] 4,233,822

[45] Nov. 18, 1980

[54] KNITTING METHOD AND MACHINE

[75] Inventor: Francesco Lonati, Brescia, Italy

[73] Assignee: Costruzioni Meccaniche Lonati S.p.A., Brescia, Italy

[21] Appl. No.: 894,782

[22] Filed: Apr. 10, 1978

[30] Foreign Application Priority Data

Apr. 21, 1977 [IT] Italy ..... 22713 A/77

[51] Int. Cl.[2] ..... D04B 9/10; D04B 15/06

[52] U.S. Cl. ..... 66/14; 66/104

[58] Field of Search ..... 66/14, 104, 172 R

[56] References Cited

U.S. PATENT DOCUMENTS

| | | | |
|---|---|---|---|
| 2,442,412 | 6/1948 | Holmes et al. | 66/14 |
| 2,685,186 | 8/1954 | Deans et al. | 66/14 |

FOREIGN PATENT DOCUMENTS

| | | | |
|---|---|---|---|
| 1963630 | 7/1971 | Fed. Rep. of Germany | 66/14 |
| 247339 | 2/1926 | United Kingdom | 66/104 |
| 1066981 | 4/1967 | United Kingdom | 66/14 |

*Primary Examiner*—Wm. Carter Reynolds

*Attorney, Agent, or Firm*—Guido Modiano; Albert Josif

[57] ABSTRACT

A method for knitting a garment on a double-cylinder circular knitting machine, comprising the steps of withdrawing the stitch sinkers firstly with only the yarn taken up by the lower cylinder needles, subsequently lowering the upper cylinder needles to pick up the yarn while causing the stitch sinkers to outwardly project and to pick up the yarn taken by the upper cylinder needles, and raising the lower cylinder needles only after the sinkers have been withdrawn. There is also disclosed a double-cylinder circular knitting machine in which the cams for controlling the sinkers have a notch in a position substantially vertically below the lowering cam which controls lowering of the upper cylinder needles to take up the yarn, the notch being arranged before the raising cam controlling raising of the lower cylinder needles for taking up the yarn. Upstream of the lowering cam there is also provided in the upper cam box a pair of cams for maintaining the upper cylinder needles at a level corresponding to that at which the previously formed loop is discharged.

7 Claims, 10 Drawing Figures

PRIOR ART

KNITTING METHOD AND MACHINE

BACKGROUND OF THE INVENTION

This invention relates to a method of manufacturing a knitted garment on a double-cylinder circular knitting machine with automatic needle latch opening, i.e. having the latches of the upper and lower cylinder needles automatically opened before the needles catch the yarn, and to a machine implementing such a method.

As is known, provision is made in a double-cylinder circular knitting machine, within the cam box associated with the upper needle cylinder, for a set of cams which are arranged at each yarn or thread feed to form the stitch and are adjustable in height to adjust the length of the knitted loop formed on the upper cylinder needles. More specifically, these are superimposed cams, movable together in pairs, and defining, in the direction of movement of the upper cylinder sliders, a first raising portion corresponding to the return movement of the needles that have picked up a yarn at a respective feed, a successive partial lowering portion, corresponding to a lowering movement of the needles which have picked up a yarn, said movement having the purpose of bringing the loops, retained by the needles, to the height level of the sinkers adjacent the lower cylinder, and a further short raising portion to bring the sliders of the upper cylinder in condition for selection in order to drive or not the associated needles for forming a stitch at the successive or following feed.

When the partial lowering cam or additional knitting cam is brought to the upper limit allowed by its mobility, and this in order to obtain long stitches, it may happen that the needle is lowered to an insufficient extent for bringing the loop up to the height level of the sinker hook and that the loop stays between the needle hook and the closed latch, or that, while the needle is lowered to a sufficient extent, the loop stays on the same in a position too high for being hooked by the sinker hook at the subsequent withdrawal or return phase of the sinker. This event occurs mainly when there are two or more adjacent needles operating in the upper cylinder and when long stitches are to be formed, e.g. in manufacturing garments such as so-called panty hose, wherefrom a considerable stretching capacity is expected, or when the yarn being worked is thick and/or scarcely extendible.

Therefore, when the loop is not hooked by the hook of the withdrawing sinker, as driven by specially provided cams located in the sinker supporting ring of the lower cylinder, then the yarn is left free and the upper cylinder needles adjacent to said sinker miss the loop. However, it also happens that when, at the following feed, the needle is again lowered to pick up the yarn and the sinker is again extended outwardly, again by the sinker driving or actuating cams, to effect the hooking up of the fresh loop that the needle is going to form, the sinker meets with its back the length of yarn previously not hooked, which has by now been further lowered owing to the further lowering movement of the needle, and pushes it outwards with respect to the cylinder. The yarn, thus pushed, also entrains outwards the adjacent needle, which is thus caused to bend and insert between the latchguard cam and cylinder, thereby damaging the cams and most often a certain number of adjacent needles as well. It then becomes necessary to stop the machine, withdraw the damaged needles and replace them, overhaul the cams and possibly replace them, discharge the knitted work incomplete, before it becomes possible to resume the work. All this involves a long break in the manufacturing process, with considerable loss of productivity. In some cases, it is not uncommon for the upper cylinder knocking-over bits to break, so that it becomes necessary to disassemble the entire upper portion of the machine before it is possible to resume production. Sometimes, moreover, it may happen that the yarn of the loop, stretched between two sinkers, acts on the needle operating in the lower cylinder and dislodges it from its groove so that the overlying slider of the upper cylinder can no longer open the latch of this needle, and the latter can no longer form a stitch.

Since such drawbacks occur the more frequently the thicker is the yarn employed on a given machine, it follows that, for a given machine, it becomes impossible to go to extremes for what concern the thickness of the yarns without undergoing the risk of the failures mentioned above.

In addition, the conformation of the cams just described makes it necessary for the articles, e.g. a stocking article, to be started with the lower cylinder needles, leaving the upper cylinder needles floating, that is allowing these needles to pass high above in order to retain the initial stitch without forming any further stitches. In fact, it would be impossible to operate the needles of the upper cylinder, as it would be preferable instead both for the aesthetics of the final product (which would exhibit wide or crimped stitches on the inside rather than on the outside, as occurring heretofore) and for a reduced wear and stress of the latches of the upper cylinder needles, which keep hitting continuously the latchguard cams, because the lowering of the needles under the action of the additional stitch cam to bring the yarn under the hook of the sinker would cause the needles of the upper cylinder to interfere with the elastic thread which is weft inserted at the start of the stocking article, moving the elastic thread away from the weft position and preventing the weft insertion thereof.

On the other hand, the removal or elimination of the additional stitch cam is not feasible, but for a few very special situations, e.g. when working alternately with a needle operating in the lower cylinder and a needle operating in the upper cylinder; for the great majority of the works, the presence of the additional stitch cam is indispensable, thereby the aforementioned drawbacks are brought about.

SUMMARY OF THE INVENTION

It is a primary object of this invention to obviate such drawbacks and limitations as mentioned above.

More particularly, the invention is directed to providing a method of manufacturing knitted garments, whereby it is possible to knit in a reliable manner, on a machine of a given fineness, yarns which are thicker than those which may be knitted on a conventional machine of similar fineness.

Within the scope of this general direction, the invention further provides a double-cylinder circular knitting machine, implementing the inventive method and being of a simpler and more economical construction than the prior art machines for producing the same type of knitwork.

It is a further object of the invention to provide a machine which, while permitting all of the normal knitworks to be produced on a conventional double-cylinder machine, offers the advantage of a higher degree of protection of the needle integrity, as well as of the sliders and cams, reducing the wear and stress thereof and increasing accordingly their life span.

These and other objects, such as will be apparent hereinafter, are achieved by a method of manufacturing knitted garments on a double-cylinder circular knitting machine with automatic needle latch opening, comprising the steps of holding the upper cylinder needles in a raised position after they have picked up the yarn and formed loops, withdrawing the stitch sinkers with their hooks engaging only the yarn portions next to the lower cylinder needles, successively lowering, in a substantially complete manner, the upper cylinder needles while causing the stitch sinkers to project outwards to pick up the yarn portions held between the upper cylinder needles, again withdrawing the stitch sinkers with said yarn portions, and raising the lower cylinder needles to the fresh yarn pick up position after the sinkers have been again withdrawn.

With the method according to this invention, the loss of the loop is avoided as well as all the damage consequent thereto, since the picking up of the loop of the upper cylinder needle by the sinker is ensured by the fully lowered position of the needle with its loop during the fresh outward movement of the sinker, as intentionally controlled to hook up the related yarn. The twice-repeated extension of the sinkers affords an effective control both of the loop pick up from the lower cylinder needles and of the loop pick up from the upper cylinder needles, thus making possible without trouble the use of thicker yarns, such as would not be possible in normal conditions. The reliability of the yarn pick up action prevents any outward bending of the needles and risk of breaking the same or machine parts.

For the implementation of the inventive method, this invention further provides a double-cylinder circular knitting machine with automatic needle latch opening, characterized in that it comprises, at each yarn feed, in the cam box associated with the upper cylinder, a pair of cams contoured to maintain the needles of the upper cylinder which have picked up the yarn at a level substantially corresponding to the level of discharge of the previously formed loops, and that the cams driving the stitch sinkers have, substantially aligned with the lower portion of the lowering cam of the upper cam box controlling the lowering of the needles to a position suitable for picking up the yarn to be knitted, a notch for the outward movement and subsequent withdrawal of the stitch sinkers, the raising cam of the cam box associated with the lower needle cylinder controlling the raising of the lower cylinder needles to a yarn pick up position of the yarn to be knitted being arranged at a position at least in part successive to said notch.

In a machine so constructed, in addition to the possibility of knitting yarns of unusual thickness for the machine fineness, it also becomes possible to considerably simplify the configuration of the cam box, removing the additional stitch cam itself as well as a certain number of movable cams, as will be explained hereinafter. The elimination of the movable cams obviously involves a structural simplification, since the various linkages and mechanisms controlling their movements are also eliminated.

BRIEF DESCRIPTION OF THE DRAWINGS

Further features and advantages of the invention will become more apparent from the ensueing detailed description of a preferred embodiment of the invention, illustrated in the accompanying drawings, where.

DESCRIPTION OF THE PREFERRED EMBODIMENTS

Figure 1:
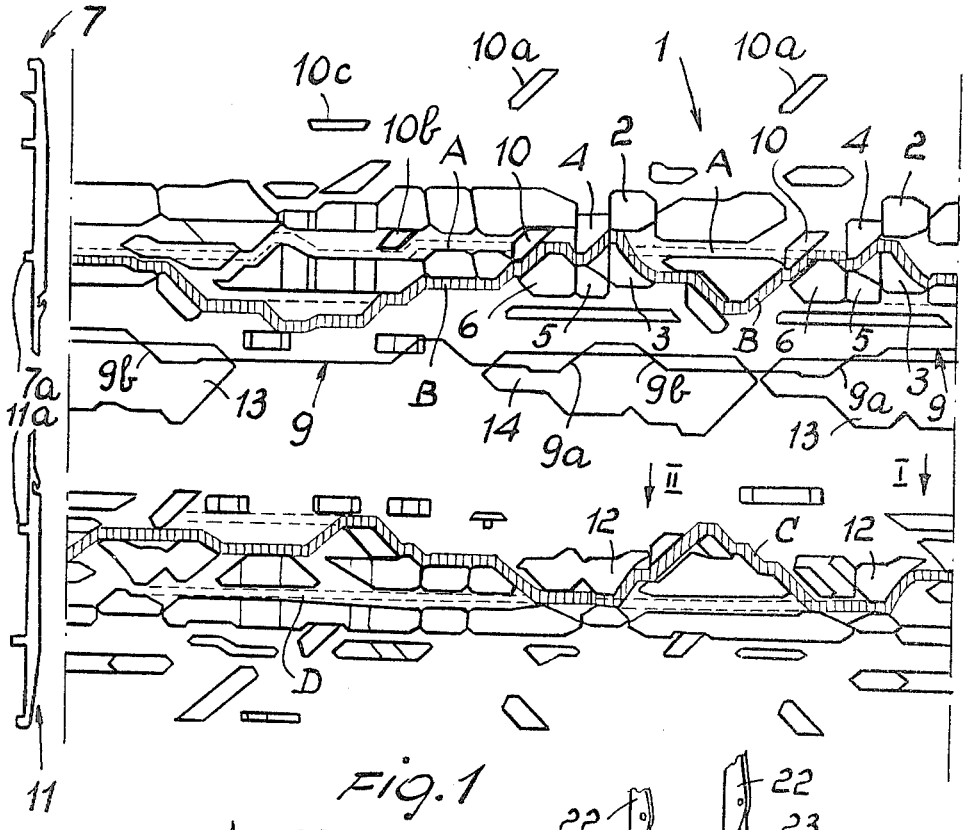
FIG. 1 is a developed representation of the central and upper portions of the cams of a double-cylinder machine of conventional design.
Figure 4:
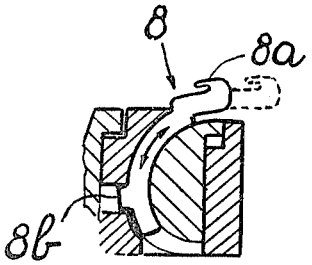
FIG. 4 shows a sinker of the machine, its position of maximum outward projection with respect to the cylinder being indicated in dotted lines.

Making reference initially to FIG. 1, it can be observed that there are provided, at the feeds I and II and in the cam box 1 associated with the upper needle cylinder of a conventional machine, a set of cams 2,3,4,5 and 6, which are movable parallel along their heights and define the movement of the knitting needles, said cams being engaged, in a known manner, by the butts 7*a* of the sliders 7 of the upper cylinder carrying the needles that are rib-knitting. More specifically, the numeral 4 denotes the additional stitch cam which is effective to partially lower the needles operating in the upper cylinder to bring the loops, situated around the needles, to the height level of the hooks 8*a* of the stitch sinkers 8 (FIG. 4). The sinkers 8 are moved, in a known manner, under the drive of the cam 9, whereof only the upper portion is visible in the drawing, said cam comprising, as is known in the art, a continuous groove wherein the butt 8*b* is slidable with which every sinker is provided. It will be noted how, after the needle has been lowered under the action of the cam 4, the sinker 8 is driven or controlled to withdraw from the section 9*a* of the cam 9, which is effective to lower the butt 8*b* of the sinker 8 and accordingly rotate the latter such as to displace the hook 8*a* towards the inside of the lower cylinder (position shown in full lines in FIG. 4).

Subsequent to this, the cam 6 partially raises the slider 7 to a position such that the latter may or may not be selected by the movable cam 10 to be floated within the track A, or be further lowered to the track B to a level suitable for the picking up of a fresh yarn by the respective needle at the successive or following feed. The sinker 8 stays in its withdrawn condition until, at the section 9*b* of the cam 9, it is again extended outwards to repeat the pick up operation on the fresh loop being formed by the needle at the following feed.

That same sinker 8, as is known in the art, also effects the same operations on the yarn knitted by the lower cylinder needle, the slider 11 whereof is lowered by the stitch cam 12, which acts on the butt 11*a* movable in the track C to bring the loop of the needle to the height level of the hook 8*a* of the sinker 8.

The character D in FIG. 1 denotes the track engaged by the butts 11*a* of the sliders 11 when the respective needles are to be held in their floating condition, i.e. at a position such that they do not pick up the yarn at a given feed. At 13 and 14, there are indicated the latch-guard cams, of known design, and at 10*a*, 10*b* and 10*c*, some more cams as explained hereinafter. The remaining cams shown in FIG. 1 will be omitted from this discussion as they do not pertain to this invention.

Figure 2:
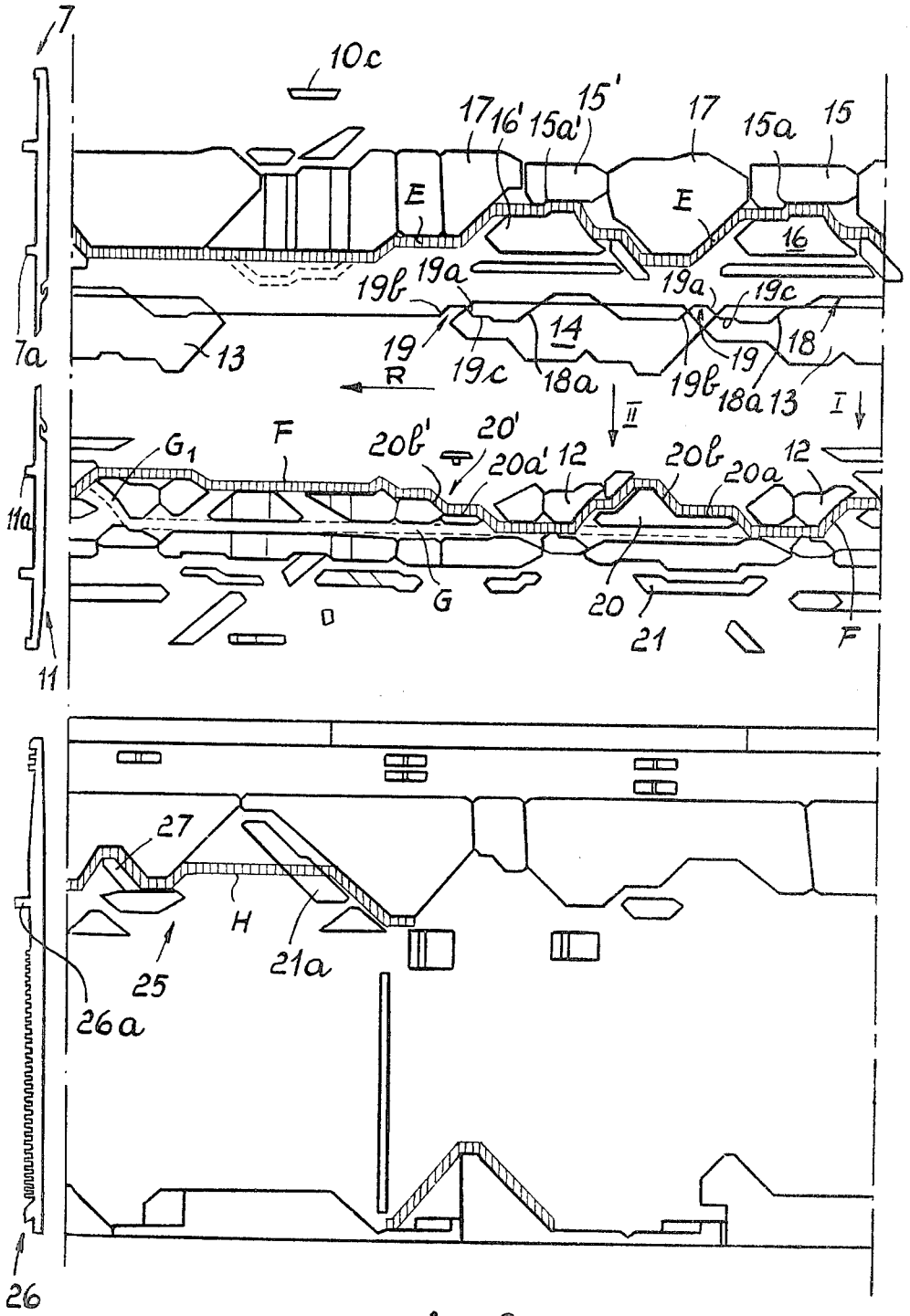
FIG. 2 is a developed representation of the complete cam box of a machine in accordance with this invention.

Making now reference to FIG. 2, it may be observed how in the inventive machine, in lieu of the cams 2–6, provision is made in the upper cam box, at each yarn feed, for a pair of cams 15, 16, respectively 15', 16', extending in a peripheral direction for a range substantially corresponding to the total range of the cams 2–6 of the prior art machine, and defining between them a passage adapted to hold the sliders 7 of the upper cylinder for a given length substantially at a level corresponding to the discharge level of the loops previously formed by the associated needles. In essence, the lowering of the sliders and corresponding needles for hooking up the loop by means of the sinkers 8 is retarded until the cam 17 (or 17') is reached, which has a continuous down incline, i.e. an incline without interruptions, and is fixed. The passage defined between the cams 15 and 16 (or 15' and 16'), which are arranged upstream of, and adjacent to, the lowering cam 17 (respectively 17'), may be entirely or throughout at the same horizontal level, or alternatively have a slight depression, such as the one defined by the section 15*a* (or 15*a'*) of the cam 15 (respectively 15'), adequate to produce a relaxation of the loop formed on the needle but not to bring the loop to the height level of the hook of the stitch sinker 8 (FIG. 4).

Figure 3:
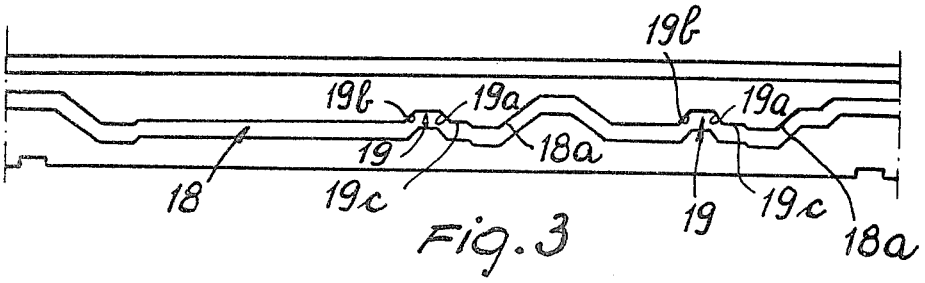
FIG. 3 is a developed representation of the pattern of the cams controlling or driving the stitch sinkers in the inventive machine.

The cam 18 (FIGS. 2 and 3), driving or controlling the sinkers, has a notch or depression 19 vertically aligned with the lower portion of the down incline of the lowering cam 17 respectively 17', with an ascending portion 19*a* and a descending portion 19*b*, the depth of the notch being such as to cause the sinkers to extend outwardly by a sufficient amount to pick up the loops carried by the needles operating in the upper cylinder. Preferably, the notch 19 is preceded by a slight uprise 19*c* having the purpose of arranging the sinker in a position of slight outward extension as the upper cylinder needle is moving down already. For the rest, the cam 18 is substantially similar to the cam 9. The overall conformation of the cam 18 is best visible in FIG. 3. The cam 20, respectively 20', intended to raise the lower cylinder sliders for the subsequent yarn pick up by the corresponding needles, presents instead, as against the corresponding cam in the prior art machine, a first portion 20*a* (respectively 20*a'*) which is horizontal and of a length substantially corresponding to the circumferential width of the notch 19, whereas the ascending portion 20*b* (respectively 20*b'*) starts following the descending portion 19*b*, as referred to the needle and slider direction of movement indicated by the arrow R.

The opening of the latches of the needles operating in the upper cylinder is ensured, in the inventive machine, by the cams 21, 21*a*, which by engaging the butt of the sliders 11 arranged below butt 11*a* cause the lower cylinder sliders 11 to move along a path such that their upper tips interfere with the overlying needles held by sliders 7 which move with their butts 7*a* along path E, thus causing the opening of the latches of the overlying needles in a manner known per se.

Figure 7A:
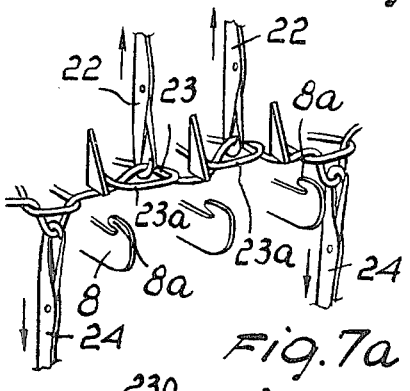
Figure 7B:
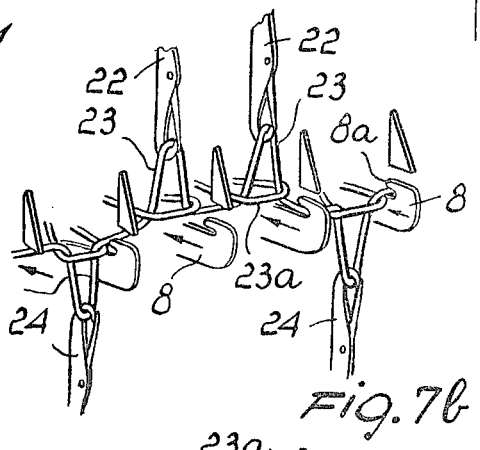

With the cam configurations just described, the knitting process is carried out as follows. Assuming that the needles operate alternatively, two in the upper cylinder and two in the lower cylinder, following the knitting tracks E and F, after the needles 22 operating in the upper cylinder have picked up the yarn (FIG. 7*a*) and are withdrawn by the corresponding sliders to form the loops 23 and discharge those previously formed (23*a*), the needles 22 are held at a raised position, thereby the formed loops 23 are at a position higher than that of the hooks 8*a* of the stitch sinkers 8, which are in a projecting position as shown by dotted lines in FIG. 4. Subsequently, the sinkers 8, being driven or controlled by the portion 18*a* of the cam 18, are withdrawn from the projecting position and hook up the yarn at a portion thereof next to the one knitted by the needles 24 of the lower cylinder, but not the portion of yarn between the needles 22 operating in the upper cylinder, which is too high (FIG. 7*b*).

Figure 7C:
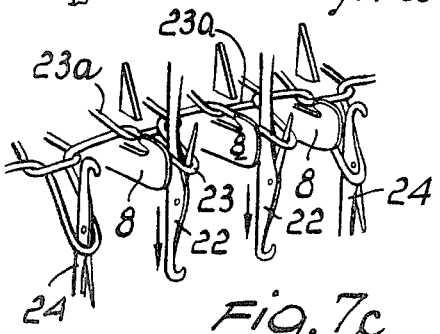
Figure 7D:
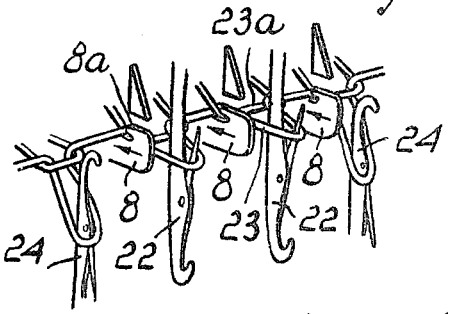
Figure 5:
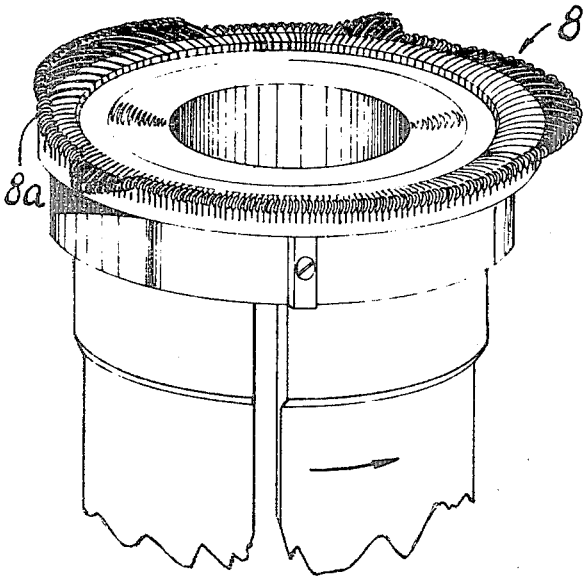
FIG. 5 is a perspective view of a portion of the lower cylinder of a machine according to the invention, from which view the cylinder proper with the needles has been omitted, the various sinkers only having been represented at the positions they take during the knitting process.
Figure 6:
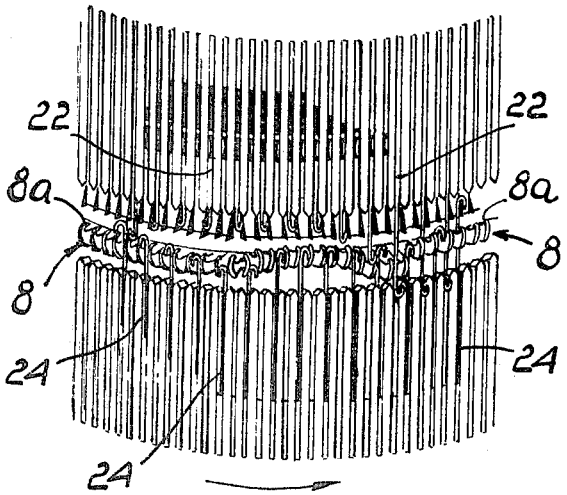
FIG. 6 is a schematic representation of the movements of the needles and sinkers at a feed of the inventive machine, being omitted from view, for clarity sake, the knitted yarn and the needle latches; and FIGS. *7a, 7b, 7c* and *7d* show some of the operative phases in forming the stitch on a machine according to this invention.

After the sinkers 8 have been withdrawn, the upper sliders 7 and related needles 22 begin to be lowered, while before the completion of such lowering the stitch sinkers 8 are again extended outwardly owing to the influence of the notch 19 (FIG. 7*c*). Upon completion of the needle 22 lowering, the sinkers 8 are driven to withdraw, while positively picking up the yarn from between the needles 22 operating in the upper cylinder thanks to the markedly low position of the latter (FIG. 7*d*). It is only after the sinkers 8 have been withdrawn, with the yarn hooked thereon, that the needles 24 operating in the lower cylinder begin to be raised, the sliders 11 whereof meet with their butt 11*a* the portion 20*b* (or 20*b'*) of the cam 20 (respectively 20'). Thus, the needles 22,24 are in a condition to again pick up the yarn at the following feed, after regularly forming stitch. FIG. 5 is a visual representation of the successive positions of the stitch sinkers around the cylinder during the knitting process, and FIG. 6 shows the needles and sinkers at each feed, although in the latter figure, for clarity reasons, it has been assumed that the needles are alternatively one in the upper cylinder and one in the lower cylinder.

As may be observed from a comparison of FIGS. 1 and 2, the machine according to this invention exhibits a simplified cam box with respect to the one of the prior art machine, the additional stitch or knitting cams 4 being entirely absent and the adjacent ones reduced to but two cams 15, 16 (or 15', 16'). In the interest of a further simplification, it is possible, moreover, to eliminate the movable cams 10 and the correspondingly overlying ones 10*a*, thus eliminating the floating track A and restricting to a very limited number the several cams of the cam box 1. In this case, the initial portion of a knitwork, in particular the edge of a stocking or sock article, would be knitted through the upper cylinder needles, whereas the lower cylinder needles would be driven to move in the floating track, retaining the stitch for some turns. In FIG. 2, there is indicated at G the floating track engaged by the butts 11*a* of the sliders 11, the needles whereof operate in the lower cylinder.

By knitting the edge of the stocking or sock article with the upper cylinder needles and retaining the stitch with the lower cylinder ones, various advantages are secured over the prior art, where such knitting is carried out in the opposite way. In fact, the latches of the needles no longer interfere with the latchguard cams 13 and 14, since the needles are no longer passing in the floating position in the upper cylinder, and it is, moreover, possible to keep the stitch tighter, without in so doing urging the latch outwards against the latchguard cams, for the stitch is retained on the lower cylinder needles. Consequently, less stress and wear is exerted on the needle latches. Furthermore, the movable cam **10*b* has been removed, and the cam 10*c* becomes a fixed one. The absence of several movable cams also permits the elimination of the various linkages required for their operation, thus achieving a remarkable simplification in construction. Finally, it is no longer necessary to have the sliders with butts of the sawtooth type, as shown in FIG. 1 at the top, which, in the prior art, are the ones overlying the lower cylinder sliders which carry the knitting needles and serve to open the needle latches. In accordance with this invention, the cams 10*a*** are removed because the upper sliders require no sawtooth butts, owing to the fact that all of the upper sliders follow the normal knitting path and are lowered to a position for opening the latches of the needles operating in the lower cylinder. The further advantage is achieved that the initial knitwork has wide or crimped stitches on the inside rather than on the outside, thus conferring an improved appearance to the final product.

This same machine, as described above, also lends itself to the working of the so-called "Picot edge" type of edge, i.e. of an edge having a wavy or undulated appearance owing to stitches being retained on determined equidistant needles for a few knitting turns or passes. For this type of knitting, it will be enough to modify the cam box 25 controlling or driving the jacks 26 as shown in FIG. 2 on the left, and provide jacks of two types: a first type equipped with a selection butt arranged to control the jacks such that the respective needles are caused to knit at each feed and regularly discharge their loops; and a second type carrying no such butt and arranged to control the jacks such that the corresponding needles are caused to pick up the yarn at feed I without, however, causing them to discharge their loops. The jacks of the second type are placed, for example, at every five consecutive jacks of the first type.

The path of the butts **26*a* of the jacks of the second type is indicated at H, and the path of the butts 11*a* of the corresponding sliders at G1. It should be noted that the cam box 25 comprises a partial raising cam 27 which acts on the butts 26*a*** of the jacks of the second type so as to bring the corresponding needles to a yarn pick up position at the feed I without, however, discharging the loop formed previously. At a given point, the machine selection also brings the needles which have been retaining the stitch for a certain number of turns back to regular knitting together with the other needles, in particular to knit a ribbed knitwork all along the edge of the stocking or sock article.

With the machine just described, in addition to carrying out the knitting operations which are normal for a double-cylinder machine, while avoiding the drawbacks described in the preamble of loss of the loop and damage to the needles and cams, it has been possible to achieve knitwork for a 17 centimeters extension with cotton yarn 30/2, and knitwork with a 34 centimeters extension with Jacquard knitting, the whole on a machine having fineness 17 (3" ¼ diameter, 200 needles).

Still on the same machine, it has been possible to knit 20/2 cotton yarn, i.e. a still thicker yarn, without encountering any problems of loop discharge from the upper cylinder needles, and without experiencing the problem of the needle coming out during the knitting of the edge band in absence of knitwork tensioning by compressed air.

The invention as herein described is susceptible to many modifications and variations, all of which fall within the scope of the present inventive concept. For instance, it is not strictly necessary that the cams of the upper cam box be so configurated as to eliminate the floating track A, normally provided in the prior art machines. It is also possible to configurate the latchguard cams 13 and 14, rather than as indicated hereinabove, as described and illustrated in the copending U.S. Application Ser. No. 894,883 by the same Applicant. Obviously, the height level of the cams 15 and 16 may be adjusted to vary the stitch length.

I claim:

1. A method of manufacturing knitted garments on a double-cylinder circular knitting machine having an upper and a lower needle cylinder, latch needles therein including upper and lower cylinder needles, stitch sinkers within said lower needle cylinder, each of said stitch sinkers having a hook, and sliders for controlling said needles, comprising the steps of controlling said stitch sinkers to move in a projecting position and said upper and lower cylinder needles to pick up yarn and form loops in said yarn, holding said upper cylinder needles in a raised position after having formed said loops, withdrawing said stitch sinkers from said projecting position with said hooks engaging only portions of said yarn next to said lower cylinder needles, successively lowering, in a substantially complete manner, said upper cylinder needles while causing said stitch sinkers to newly project and to pick up portions of said yarn held between said upper cylinder needles, again withdrawing said stitch sinkers with said yarn portions, and controlling said lower and said upper cylinder needles to further pick up yarn only after said sinkers have been again withdrawn.

2. A method according to claim 1, wherein said upper cylinder needles which have picked up said yarn are slightly lowered by a sufficient amount to relax said loops carried thereby, but not sufficient to bring said loops to the level of said hooks of said stitch sinkers, before said stitch sinkers are caused to newly project.

3. A double-cylinder circular knitting machine having an upper and a lower needle cylinder, latch needles slidable therein, stitch sinkers within said lower needle cylinder, each of said stitch sinkers having a hook, a cam for controlling said stitch sinkers, sliders for controlling said latch needles, at least one yarn feed, a cam box associated with said upper needle cylinder and including a lowering cam for controlling lowering of the needles of said upper needle cylinder to a position suitable to pick up a yarn at said at least one feed, a cam box associated with said lower needle cylinder and including a cam for controlling raising of the needles of said lower needle cylinder to a position suitable to pick up said yarn at said at least one feed, said cam box associated with said upper needles cylinder further comprising a pair of cams arranged upstream of, and adjacent to, said lowering cam and shaped to maintain the needles of said upper needle cylinder in a raised position at a level substantially corresponding to the level at which previously formed loops are discharged, said cam for controlling said stitch sinkers comprising a notch arranged substantially in vertical alignment with said lowering cam for causing outward projection of said sinkers and subsequent withdrawal, said raising cam being arranged in a position at least in part successive to said notch.

4. A machine according to claim 3, wherein said cams of said pair define a passage having a slight depression, said depression being sufficient to relax loops carried by the needles of said upper needle cylinder without bringing said loops to the height level of said hooks of said hooked stitch sinkers.

5. A machine according to claim 3, wherein said cam for controlling said stitch sinkers has a slight uprise preceding said notch.

6. A machine according to claim 3, wherein said raising cam has a first substantially horizontal portion underlying said notch and having a length substantially corresponding to the circumferential width of said notch.

7. A double-cylinder circular knitting machine having an upper and a lower needle cylinder, latch needles slidable therein stitch sinkers within said lower needle cylinder, each of said stitch sinkers having a hook, a cam for controlling said stitch sinkers, sliders for controlling said latch needles, at least one yarn feed, a cam box associated with said upper needles cylinder and including a lowering cam for controlling lowering of the needles of said upper needle cylinder to a position suitable to pick up a yarn at said at least one feed, a cam box associated with said lower needle cylinder and including a cam for controlling raising of the needles of said lower needle cylinder to a position suitable to pick up said yarn at said at least one feed, said cam box associated with said upper needle cylinder further comprising a pair of cams arranged upstream of said lowering cam and shaped to maintain the needles of said upper needle cylinder at a level substantially corresponding to the level at which previously formed loops are discharged, said cam for controlling said stitch sinkers comprising a notch arranged substantially in vertical alignment with said lowering cam for causing outward projection of said sinkers and subsequent withdrawal, said raising cam being arranged in a position at least in part successive to said notch, the machine further comprising a lower cam box and jacks controlled thereby, said lower cam box comprising a partial raising cam adapted to raise part of said jacks such as to bring the corresponding needles of said lower needle cylinder to pick up said yarn without discharging said previously formed loops.

* * * * *